US005489363A

United States Patent [19]

Marcoccia et al.

[11] Patent Number: 5,489,363

[45] Date of Patent: Feb. 6, 1996

[54] PULPING WITH LOW DISSOLVED SOLIDS FOR IMPROVED PULP STRENGTH

[75] Inventors: Bruno S. Marcoccia, South Glens Falls; J. Robert Prough, Queensbury; Richard O. Laakso, Queensbury; Joseph R. Phillips, Queensbury, all of N.Y.; Rolf C. Ryham, Roswell, Ga.; Jan T. Richardsen, Glens Falls; R. Fred Chasse, Queensbury, both of N.Y.

[73] Assignee: Kamyr, Inc., Glens Falls, N.Y.

[21] Appl. No.: 56,211

[22] Filed: May 4, 1993

[51] Int. Cl.[6] ..... D21C 7/00; D21C 7/14

[52] U.S. Cl. ..... 162/43; 162/16; 162/42; 162/29; 162/30.11; 162/249; 162/250

[58] Field of Search ..... 162/16, 42, 43, 162/59, 29, 30.11, 249, 250

[56] References Cited

U.S. PATENT DOCUMENTS

| | | | |
|---|---|---|---|
| 3,617,431 | 2/1971 | Croon et al. | 162/17 |
| 4,690,731 | 9/1987 | Hartler et al. | 162/45 |
| 4,929,307 | 5/1990 | Kiiskila | 159/47.3 |
| 5,053,108 | 10/1991 | Richter | 162/237 |
| 5,080,755 | 1/1992 | Backlund | 162/19 |
| 5,192,396 | 3/1993 | Backlund | 162/19 |
| 5,213,662 | 5/1993 | Henricson | 162/19 |

FOREIGN PATENT DOCUMENTS

| | | |
|---|---|---|
| 476230 | 3/1992 | European Pat. Off. . |
| 0477059A2 | 3/1992 | European Pat. Off. . |

OTHER PUBLICATIONS

Hartler, "Extended Delig . . . New Concept", 1978, Svensk Pappersidning 15:483.

ITD #118702 "Extended Delig./Modified . . . Pulp", Nov. 1987, Kamyr, Inc., vol. 5, No. 11.

Sjoblom, et al., "Extended Delignification in Kraft . . . Part II", Paperi ja Pue, No. 5, 1988.

Sjoblom et al., "Extended Delignification in . . . Part 1 . . . ", No. 4, 1983 Paperi ja Puu.

Sjoblom, "Extended Delignification in Kraft . . . Part III", Nordic Pulp & Paper Journal, No. 1, Apr., 1988.

Sjoblom et al., "Extended Delignification in . . . Part IV . . . ", Paperi ja Puu, No. 1, 1990.

Svensk Pappersidning 15:483 (1978); Hartler, "Extended Delignification in Kraft Cooking—A New Concept".

International Technology Disclosures #118702, "Extended Delignificaton/Modified Cooking of Paper Pulp", Kamyr, Inc., vol. 5, No. 11, 25 Nov. 1987.

*Primary Examiner*—David L. Lacey
*Assistant Examiner*—Dean T. Nguyen
*Attorney, Agent, or Firm*—Nixon & Vanderhye

[57] ABSTRACT

Kraft pulp of increased strength (e.g. at least about 15% greater tear strength at a specified tensile for fully refined pulp, and as much as about 27%) is produced by keeping the dissolved organic material (DOM) concentration below about 100 g/l (e.g. <50 g/l) throughout substantially the entire kraft cook. This may be done by extracting liquor containing a level of DOM substantial enough to adversely affect pulp strength, and replacing some or all of the extracted liquor with liquor containing a substantially lower effective DOM level than the extracted liquor, so as to positively affect pulp strength. The replacement liquor may be water, white liquor, pressure heat treated black liquor, washer filtrate, cold blow filtrate, or combinations, or the extracted liquor can be treated to remove or passivate the DOM (e.g. by precipitation, ultrafiltration, or absorption). The extraction and dilution provided is practiced at a number of different stages during kraft cooking, such as at three or more different levels in a continuous digester, or by continuously flowing low DOM concentration liquor through a batch digester.

41 Claims, 4 Drawing Sheets

PULPING WITH LOW DISSOLVED SOLIDS FOR IMPROVED PULP STRENGTH

BACKGROUND AND SUMMARY OF THE INVENTION

According to conventional knowledge in the art of kraft pulping of cellulose, the level of dissolved organic materials (DOM) - - - which mainly comprise dissolved hemi-cellulose, and lignin, but also dissolved cellulose, extractives, and other materials extracted from wood by the cooking process - - - is known to have a detrimental affect in the later stages of the cooking process by impeding the delignification process due to consumption of active cooking chemical in the liquor before it can react with the residual or native lignin in wood. The effect of DOM concentration at other parts of cooking, besides the later stages, is according to conventional knowledge believed insignificant. The impeding action of DOM during the later stages of the cook is minimized in some state-of-the-art continuous cooking processes, particularly utilizing an EMCC® digester from Kamyr, Inc. of Glens Falls, N.Y., since the counter-current flow of liquor (including white liquor) at the end of the cook reduces the concentration of DOM both at the end of the "bulk delignification" phase, and throughout the so-called "residual delignification" phase.

According to the present invention, it has been found that not only does DOM have an adverse affect on cooking at the end of the cooking phase, but that the presence of DOM adversely affects the strength of the pulp produced during any part of the cooking process, that is at the beginning, middle, or end of the bulk delignification stage. The mechanism by which DOM affects pulp fibers and thereby adversely affects pulp strength has not been positively identified, but it is hypothesized that it is due to a reduced mass transfer rate of alkali extractable organics through fiber walls induced by DOM surrounding the fibers, and differential extractability of crystalline regions in the fibers compared to amorphous regions (i.e. nodes). In any event, it has been demonstrated according to the invention that if the DOM level (concentration) is minimized throughout the cook, pulp strength is increased significantly.

It has been found, according to the present invention, that if the level of DOM is close to zero throughout a kraft cook, tear strength of the pulp is greatly increased, i.e. increased up to about 25% (e.g. 27%) at 11 km tensile compared to conventionally produced kraft pulp. Even reductions of the DOM level to one-half or one-quarter of their normal levels also significantly increase pulp strength.

In state-of-the-art kraft cooks, it is not unusual for the DOM concentration at some points during the kraft cook to be 130 grams per liter (g/l) or more, and at 100 g/l or more at numerous points during the kraft cook (for example in the bottom circulation, trim circulation, upper and main extractions and MC circulation in Kamyr, Inc. MCC® continuous digesters), even if the DOM level is maintained between about 30–90 g/l in the wash circulation (at later cook stages, according to conventional wisdom). In such conventional situations it is also not unusual for the lignin component of the DOM level to be over 60 g/l and in fact even over 100 g/l, and for the hemi-cellulose component of the DOM level to be well over 20 g/l. It is not known if the dissolved hemi-cellulose component has a stronger adverse affect on pulp strength (e.g. by adversely affecting mass transfer of organics out of the fibers) than lignin, or vice versa, or if the effect is synergistic, although the dissolved hemi-celluloses are suspected to have a significant influence.

According to the present invention it has been recognized for the first time that the DOM concentration throughout a kraft cook should be minimized in order to positively affect bleachability of the pulp, reduce chemical consumption, and perhaps most significantly increase pulp strength. By minimizing DOM levels, one may be able to design smaller continuous digesters while obtaining the same throughput, and may be able to obtain some benefits of continuous digesters with batch systems. A number of these beneficial results can be anticipated by keeping the DOM concentration at 100 g/l or less throughout substantially the entire kraft cook (i.e., beginning, middle and end of bulk delignification), and preferably about 50 g/l or less (the closer to zero DOM one goes, the more positive the results). It is particularly desirable to keep the lignin component at 50 g/l or less (preferably about 25 g/l or less), and the hemi-cellulose level at 15 g/l or less (preferably about 10 g/l or less).

According to the present invention it has also been found that it is possible to passivate the adverse affects on pulp strength of tile DOM concentration, at least to a large extent. According to this aspect of the invention it has been found that if black liquor is removed and subjected to pressure heat treatment according to U.S. Pat. No. 4,929,307 (the disclosure of which is hereby incorporated by reference herein), e.g. at a temperature of about 170°–350° C. (preferably 190° C.) for about 5–90 minutes (preferably about 30–60 minutes) and then reintroduced, an increase in tear strength of up to about 15% can be effected. The mechanism by which passivation of the DOM by heat treatment occurs also is also not fully understood, but is consistent with the hypothesis described above, and its results are real and dramatic.

According to the present invention-various methods are provided for increasing kraft pulp strength taking into account the adverse affects of DOM thereon, as set forth above, for both continuous and batch systems. Also according to the present invention increased strength kraft pulp is also provided, as well as apparatus for achieving the desired results according to the invention.

According to one aspect of the present invention, a method of producing kraft pulp by cooking comminuted cellulosic fibrous material is provided. The method comprises the steps of continuously, at a plurality of different stages during kraft cooking of the material to produce pulp: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength. Step (b) is typically practiced by replacing the withdrawn liquor with liquor selected from the group consisting essentially of water, substantially DOM free white liquor, pressure-heat treated black liquor, washer filtrate, cold blow filtrate, and combinations thereof. For example for at least one stage during cooking, black liquor may be withdrawn, and treated under pressure and temperature conditions (e.g. superatmospheric pressure at a temperature of about 170°–350° C. for about 5–90 minutes, and at least 20° C. over the cooking temperature) to significantly passivate the adverse affects of DOM. The term "effective DOM" as used in the specification and claims means that portion of the DOM that affects pulp strength. A low effective DOM may be obtained by passivation, or by an originally low DOM concentration.

The method according to the invention can be practiced in a continuous vertical digester, in which case steps (a) and (b) are practiced at at least two different levels of the digester. There is also typically the further step (c) of heating the replacement liquor from step (b) to substantially the same temperature as the withdrawn liquor prior to the replacement liquor being introduced into contact with the material being cooked. Steps (a) and (b) can be practiced during impregnation, near the start of the cook, during the middle of the cook, and near the end of the cook, i.e. during substantially the entire bulk delignification stage.

According to another aspect of the present invention a method of kraft cooking is provided comprising the steps of, near the beginning of the kraft cook: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength.

According to another aspect of the present invention a method of kraft cooking is provided comprising the steps of, during impregnation of cellulosic fibrous material: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength.

According to still another aspect of the present invention a method of kraft cooking pulp is provided comprising the following steps: (a) Extracting black liquor from contact with the pulp at a given cooking stage. (b) Pressure-heating the black liquor to a temperature sufficient to significantly passivate the adverse effects on pulp strength of DOM therein. And, (c) re-introducing the passivated-DOM black liquor back into contact with the pulp at the given stage.

The invention also comprises the kraft pulp produced by the methods set forth above. This kraft pulp is different than kraft pulps previously produced, having a tear strength as much as 25% greater at a specified tensile for fully refined pulp (e.g. at 9 km tensile, or at 11 km tensile) (and at least about 15% greater) compared to kraft pulp produced under identical conditions without the DOM maintenance or removal steps according to the invention, or as much as 15% greater (e.g. at least about 10% greater) where passified black liquor is utilized.

The invention is also applicable to kraft batch cooking of cellulosic fibrous material utilizing a vessel containing black liquor and a batch digester containing the material. In such a method of kraft batch cooking according to the invention there are the steps of: (a) Pressure-heating the black liquor in the vessel to a temperature sufficient to passivate the adverse effects on pulp strength of DOM therein. And, (b) feeding the black liquor to the digester to contact the cellulosic fibrous material therein. Step (a) is practiced to heat the black liquor at superatmospheric pressure at a temperature of about 170°–350° C. for about 5–90 minutes (typically at least about 190° C. for about 30–60 minutes, and at least 20° C. over cooking temperature), and step (b) may be practiced to simultaneously feed black liquor and white liquor to the digester to effect cooking of the cellulosic fibrous material.

According to another aspect of the present invention an apparatus for kraft cooking cellulose pulp is provided. The apparatus comprises the following elements: An upright continuous digester. At least two withdrawal/extraction screens provided at different levels, and different cook stages, of the digester. A recirculation line and an extraction line associated with each of the screens. And, means for providing replacement liquor to the recirculation line to make up for the liquor extracted in the extraction line, for each of the recirculation lines. Each recirculatory loop typically includes a heater, and the digester may be associated with a separate impregnation vessel in which removal of high DOM concentration liquor and replacement with lower DOM concentration liquor also takes place (including in a return line communicating between the top of the impregnation vessel and the high pressure feeder).

The invention also relates to a commercial method of kraft cooking comminuted cellulose fibrous material by the step (a) of continuously passing substantially DOM-free cooking liquor into and out of contact with the material until completion of the kraft cook thereof, at a rate of at least 100 tons of pulp per day. This method is preferably practiced utilizing a batch digester, and by the further step (b), prior to step (a), of filling the digester with cellulose material, and the further step (c), after step (a) of discharging kraft pulp from the digester. The invention also relates to a batch digester system for practicing this aspect of the invention.

It is the primary object of the invention to produce increased strength kraft pulp. This and other objects of the invention will become clear from an inspection of the detailed description of the invention and from the appended claims.

DETAILED DESCRIPTION OF THE DRAWINGS

Figure 1:
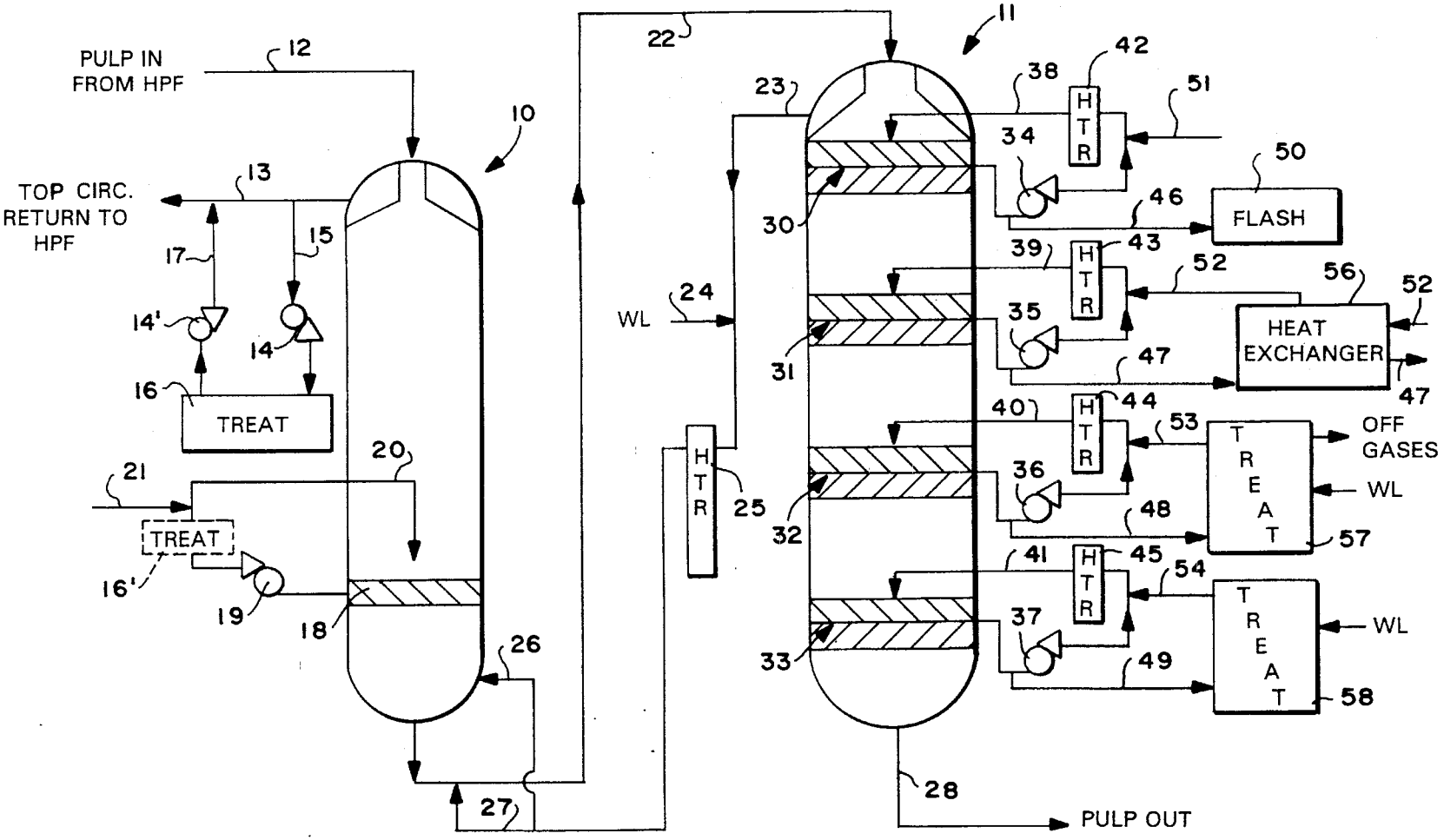
FIG. 1 is a schematic illustration of one exemplary embodiment of continuous kraft cooking equipment according to the invention, for practicing exemplary methods according to the present invention.

FIG. 1 illustrates a two vessel hydraulic kraft digester system, such as that sold by Kamyr, Inc. of Glens Falls, N.Y. modified to practice exemplary methods according to the present invention. Of course any other existing continuous digester systems also can be modified to practice the invention, including single vessel hydraulic, single vessel vapor phase, and double vessel vapor phase digesters.

In the exemplary embodiment illustrated in FIG. 1, a conventional impregnation vessel (IV) 10 is connected to a conventional vertical continuous digester 11. Comminuted cellulosic fibrous material entrained in water and cooking liquor is transported from a conventional high pressure feeder via line 12 to the top of the IV 10, and some of the liquor is withdrawn in line 13 as is conventional and returned to the high pressure feeder. According to the present invention, in order to reduce the concentration of DOM (as used in this specification and claims dissolved organic materials, primarily dissolved hemi-cellulose and lignin, but also dissolved cellulose, extractives, and other materials extracted from wood by the kraft cooking process) liquor is withdrawn by pump 14 in line 15 (or from the top of vessel 10) and treated at stage 16 to remove or passivate DOM, or selected constituents thereof. The stage 16 may be a precipitation stage (e.g. by lowering pH below 9), an absorption stage (e.g. a cellulose fiber column, or activated carbon), or devices for practicing ultrafiltration, solvent extraction, destruction (e.g. by bombardment with radiation), supercritical extraction, gravity separation, or evaporation (followed by condensation).

Replacement liquor (e.g. after stage 16) may or may not be is added to the line 13 by pump 14 in line 17, depending upon whether impregnation is practiced co-currently or counter-currently. The replacement liquor added in line 17, instead of extracted liquor treated in stage 16, may be dilution liquor, e.g. fresh (i.e. substantially DOM-free) white liquor, water, washer filtrate (e.g. brownstock washer filtrate), cold blow filtrate, or combinations thereof.

If it is desired to enhance the sulfidity of the liquor being circulated in the lines 12, 13, black liquor may be added in line 17, but the black liquor must be treated so as to effect passivation of the DOM therein, as will be described hereafter.

In any event, the liquor withdrawn at 15 has a relatively high DOM concentration, while that added in 17 has a much lower effective DOM level, so that pulp strength is positively affected.

In the impregnation vessel 10 itself the DOM is also controlled preferably utilizing a conventional screen 18, pump 19, and reintroduction conduit 20. To the liquid recirculated in conduit 20 is added - - - as indicated by line 21 - - - dilution liquid, to dilute the concentration of the DOM. Also the dilution liquid includes at least some white liquor. That is the liquor reintroduced in conduit 20 will have a substantially lower effective DOM level than the liquor withdrawn through the screen 18, and will include at least some white liquor. A treatment stage 16' - - - like stage 16 - - - also may be provided in conduit 20 as shown in dotted line in FIG. 1.

From the bottom of the IV 10 the slurry of comminuted cellulosic fibrous material passes through line 22 to the top of the digester 11, and as is known some of the liquid of the slurry is withdrawn in line 23, white liquor is added thereto at 24, and passes through a heater (typically an indirect heater) 25, and then is reintroduced to the bottom of the IV 10 via line 26 and/or introduced close to the start of the conduit 22 as indicated at 27 in FIG. 1..

In existing continuous digesters, usually liquid is withdrawn at various levels of the digester, heated, and then reintroduced at the same level as withdrawn, however under normal circumstances liquor is not extracted from the system and replaced with fresh liquor. In existing continuous digesters, black liquor is extracted at a central location in the digester, and the black liquor is not reintroduced, but rather it is sent to flash tanks, and then ultimately passed to a recovery boiler or the like. In contra-distinction to existing continuous digester, the continuous digester 11 according to the present invention actually extracts liquor at a number of different stages and heights and replaces the extracted liquor with liquor having a lower DOM concentration. This is done near the beginning of the cook, in the middle of the cook, and near the end of the cook. By utilizing the digester 11 illustrated ill FIG. 1, and practicing the method according to the invention, the pulp discharged in line 28 has increased strength compared to conventional kraft pulp treated under otherwise identical conditions in an existing continuous digester.

The digester 11 includes a first set of withdrawal screens 30 adjacent the top thereof, near the beginning of the cook, a second set of screens 31 near the middle of the cook and third and fourth sets of screens 32, 33 near the end of the cook. The screens 30–33 are connected to pumps 34–37, respectively, which pass through recirculation lines 38-41, respectively, optionally including heaters 42–45, respectively, these recirculation loops per se being conventional. However according to the present invention part of the withdrawn liquid is extracted, in the lines 46–49, respectively, as by passing the line 46 to a series of flash tanks 50, as shown in association with the first set of screens 30 in FIG. 1.

To make up for the extracted liquor, which has a relatively high DOM concentration, and to lower the DOM level, replacement (dilution) liquor is added, as indicated by lines 51 through 54, respectively, the liquor added in the lines 51 through 54 having a significantly lower effective DOM concentration than the liquor extracted in lines 46–49, so as to positively affect pulp strength. The liquor added in lines 51 through 54 may be the same as the dilution liquors described above with respect to line 17. The heaters 42–45 heat the replacement liquor, as well as any recirculated liquor, to substantially the same temperature as (typically slightly above) the withdrawn liquor.

Any number of screens 30–33 may be provided in digester 11.

Prior to transporting the extracted liquor to a remote site and replacing it with replacement liquor, the extracted liquor and the replacement liquor can be passed into heat exchange relationship with each other, as indicated schematically by reference numeral 56 in FIG. 1. Further, the extracted liquor can be treated to remove or passify the DOM therein, and then be immediately reintroduced as the replacement liquor (with other, dilution, liquor added thereto if desired). This is schematically illustrated by reference numeral 57 in FIG. 1 wherein the extracted liquor in line 48 is treated at station 57 (like stage 16) to remove DOM, and then reintroduced at 53. White liquor is also added thereto as indicated in FIG. 1, as a matter of fact at each of the stages associated with the screens 30–33 in FIG. 1 white liquor call be added (to lines 51–54, respectively) .

Another option for the treatment block 57 - - - schematically illustrated in FIG. 1 - - - is black liquor pressure heating. From the screens 32 liquor that may be considered "black liquor" is withdrawn, and a portion extracted in line 48. The pressure heating in stage 57 may take place according to U.S. Pat. No. 4,929,307, the disclosure of which is hereby incorporated by reference herein. Typically, in stage 57 the black liquor would be heated to between about 170°–350° C. (preferably above 190° C.) at superatmospheric pressure for about 5–90 minutes (preferably about 30–60 minutes), at least 20° C. over cooking temperature. This results in signification passivation of the DOM, and the black liquor may then be returned as indicated by line 53.

The treatment stage illustrated schematically at 58 in FIG. 1, associated with the last set of withdrawal/extraction screens 33, is like stage 16. A stage like 58 may be provided, or omitted, at any level of the digester 11 where there is extraction instead of adding dilution liquor. White liquor may be added at 58 too, and then the now DOM-depleted liquor is returned in line 54.

Whether treated extracted liquor or dilution liquor is utilized, according to the invention it is desirable to keep the total DOM concentration of the cooking liquor at 100 g/l or below during substantially the entire kraft cook (bulk delignification), preferably below about 50 g/l; and also to keep the lignin concentration at 50 g/l or below (preferably about 25 g/l or less), and the hemi-cellulose concentration at 15 g/l or less (preferably about 10 g/l or below). The exact commercially optimum concentration is not yet known, and may differ depending upon wood species being cooked.

Figure 3:
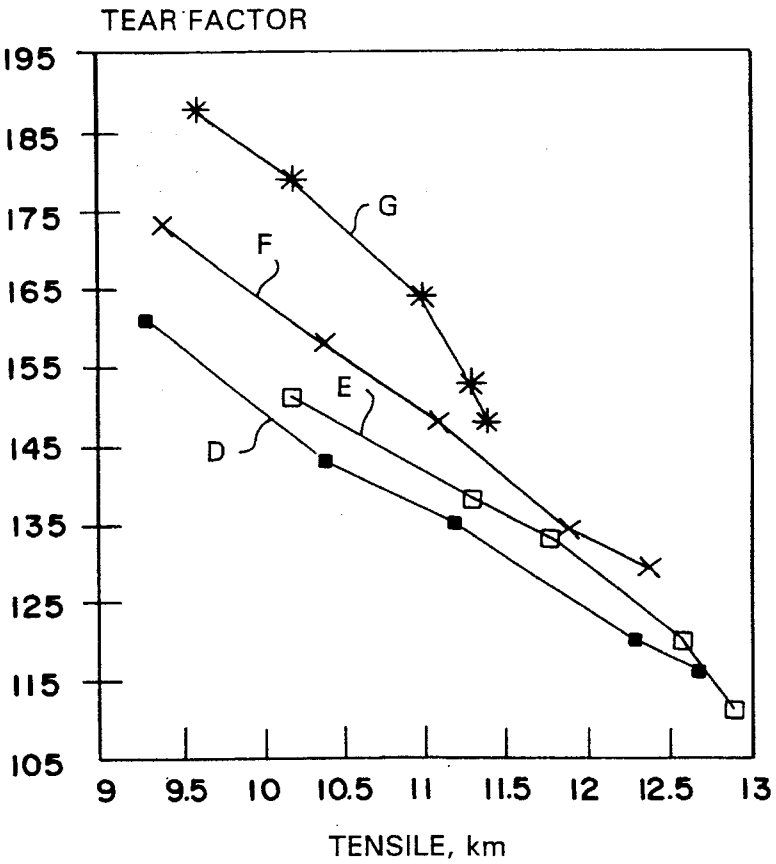
FIGS. 2 and 3 are graphical representations of the strength of pulp produced according to the present invention compared with kraft pulp produced under identical conditions only not practicing the invention.
Figure 2:
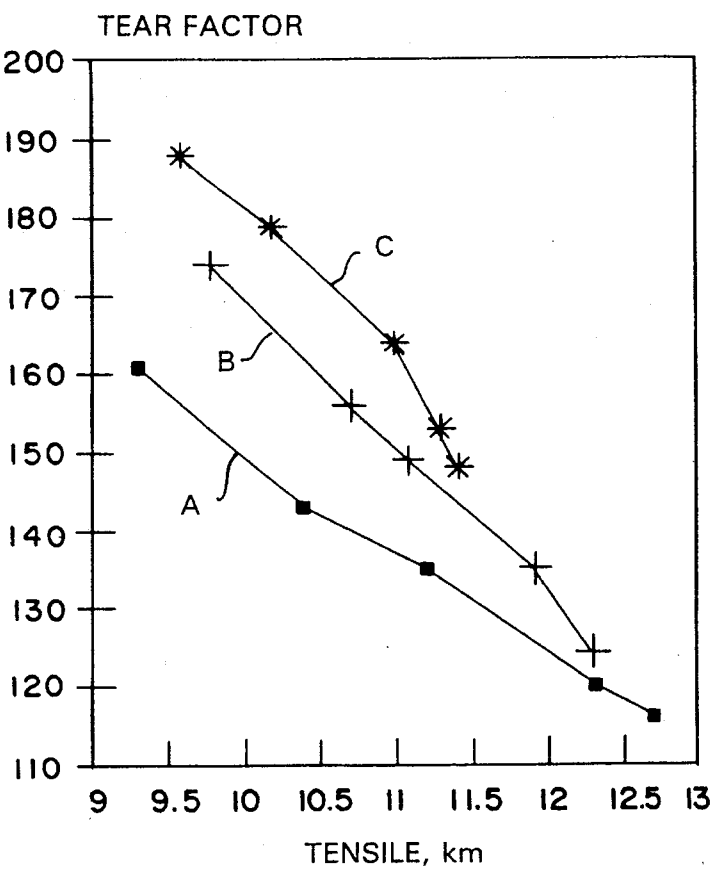

FIGS. 2 and 3 illustrate the results of actual laboratory testing pursuant to the present invention. FIG. 2 shows tear-tensile curves for three different laboratory kraft cooks all prepared from the same wood furnish. The tear factor is a measure of the inherent fiber and pulp strength.

In FIG. 2 curve A is pulp prepared utilizing conventional pulp mill liquor samples (from an MCC® commercial full scale pulping process) as the cooking liquor. Curve B is obtained from a cook where the cooking liquor is the same as in curve A except that the liquor samples were heated at about 190° C. for one hour, at superatmospheric pressure, prior to use in the cook. Curve C is a cook which used synthetic white liquor as the cooking liquor, which synthetic white liquor was essentially DOM-free, (i.e. less than 50 g/l). The cooks for curves A and B were performed such that the alkali, temperature (about 160° C.), and DOM profiles were identical to those of the full-scale pulping process from which the liquor samples were obtained. For curve C the alkali and temperature profiles were identical to those in curves A and B, but no DOM was present.

FIG. 2 clearly illustrates that as a result of low DOM liquor contacting the chips during the entire kraft cook, there is approximately a 27% increase in tear strength at 11 km tensile. Passivation of the DOM utilizing pressure heating of black liquor, pursuant to curve B according to the invention, also resulted in a substantial strength increase compared to the standard curve A, in this case approximately a 15% increase in tear strength at 11 km tensile.

FIG. 3 illustrates further laboratory work comparing conventional kraft cooks with cooks according to the invention. The cooks represented by curves D through G were prepared utilizing identical alkali and temperature profiles, for the same wood furnish, but with varying concentrations of DOM for the entire kraft cook. The DOM concentration for curve D, which was a standard MCC® kraft cook (mill liquor) was the highest, and the DOM concentration for curve G was the lowest (essentially DOM-free). The DOM concentration for curve E was about 25% lower than the DOM concentration for curve D, while the DOM concentration for curve F was about 50% lower than the DOM concentration for curve D. As can be seen, there was a substantial increase in tear strength inversely proportional to tile amount of DOM during the complete cook.

Cooking according to the invention is preferably practiced to achieve a pulp strength (e.g. tear strength at a specified tensile for fully refined pulp, e.g. 9 or 11 km) increase of at least about 10%, and preferably at least about 15%, compared to otherwise identical conditions but where DOM is not specially handled.

While with respect to FIG. 1 the invention was described primarily with respect to continuous kraft cooking, the principles according to the invention are also applicable to batch kraft cooking.

Figure 4:
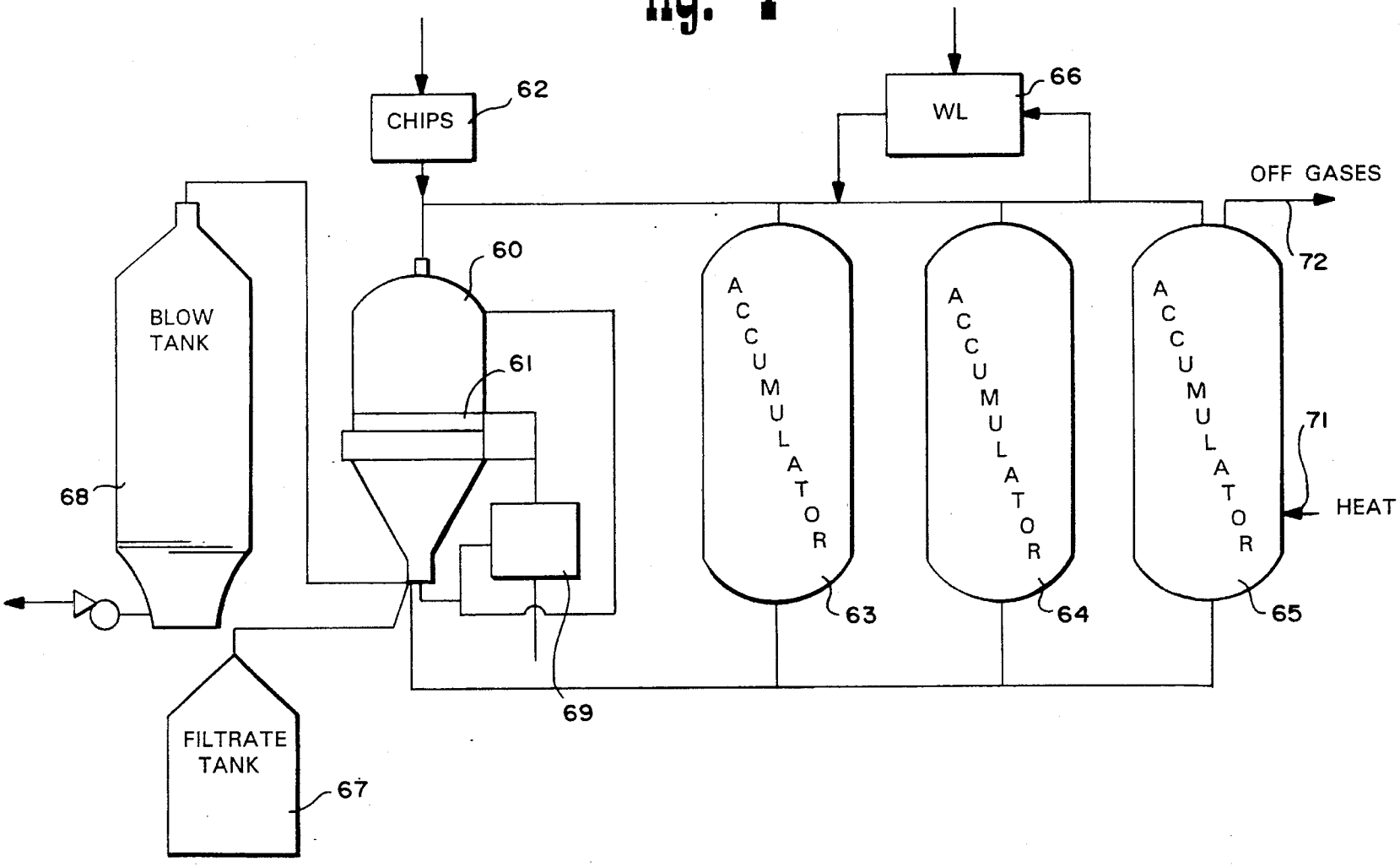
FIG. 4 is a schematic view of exemplary equipment for the improved method of batch kraft cooking according to the invention.

FIG. 4 schematically illustrates conventional equipment that may be used in the practice of the Beloit RDH™ batch cooking process, or for the Sunds Super Batch™ process. The system is illustrated schematically in FIG. 4 includes a batch digester 60 having withdrawal screen 61, a source of chips 62, first, second and third accumulators 63, 64, 65, respectively, a source of white liquor 66, a filtrate tank 67, a blow tank 68, and a number of valving mechanisms, the primary valving mechanism illustrated schematically at 69.

In a typical conventional operating cycle for the Beloit RDH™ process, the digester 60 is filled with chips from source 62 and steamed as required. Warm black liquor is then fed to the digester 60. The warm black liquor typically has high sulfidity and low alkalinity, and a temperature of about 110°–125° C., and is provided by one of the accumulators (e.g. 63). Any excess warm black liquor may pass to a liquor tank and ultimately to evaporators, and then to be passed to chemical recovery. After impregnation, the warm black liquor in digester 60 is returned to accumulator 63, and then the digester 60 is filled with hot black and white liquor. The hot black liquor may be from accumulator 65, and the hot white liquor from accumulator 63, ultimately from source 66. Typically the white liquor is at a temperature of about 155° C., while the hot black liquor is at a temperature of about 150°–165° C. The chips in the digester 60 are then cooked for the predetermined time at temperature to achieve the desired H factor, and then the hot liquor is displaced with filtrate direct to the accumulator 65, the filtrate being provided from tank 67. The chips are cold blown by compressed air, or by pumping, from the vessel 60 to the blow tank 68.

During the typical RDH™ process, white liquor is continuously preheated with liquor from the hot black liquor accumulator and then is stored in the hot white liquor accumulator 64. The black liquor passes to the warm weak black liquor accumulator 63, and the warm black liquor passes through a heat exchanger to make hot water and is stored in an atmospheric tank before being pumped to the evaporators.

With regard to FIG. 4, the only significant difference between the invention and the process described above is the heating of the black liquor, which may take place directly in accumulator 65, in such as way as to effect significant passivation of the DOM therein. For example this is accomplished by heating the black liquor to at least 20° C. above cooking temperature, e.g. under superatmospheric pressure to at least 170° C. for about 5–90 minutes, and preferably at or above 190° C. for about 5–90 minutes. FIG. 4 schematically illustrates this additional heat being applied at 71; the heat may be from any desired source. During this pressure heating of the black liquor, off-gases rich in organic sulfur compounds are produced and withdrawn as indicated at 72. Typically, as known per se, the DMS (dimethyl sulfide) produced in line 72 is converted to methane and hydrogen sulfide, and the methane can be used as a fuel supplement (for example to provide the heat in line 71) while the hydrogen sulfide can be used to pre-impregnate the chips at source 62 prior to pulping, can be converted to elementary sulfur and removed or used to form polysulfide, can be absorbed into white liquor to produce a high sulfidity liquor, etc. If the heat treatment in accumulator 65 is to about 20°–40° C. above cooking temperature, black liquor can be utilized to facilitate impregnation during kraft cooking.

Alternatively, according to the invention, in the FIG. 4 embodiment, the valving mechanism 69 may be associated with a treatment stage, like stage 16 in FIG. 1, to remove DOM from cooking liquor being withdrawn from screen 61 and recirculated to the digester 60 during batch cooking.

Figure 5:
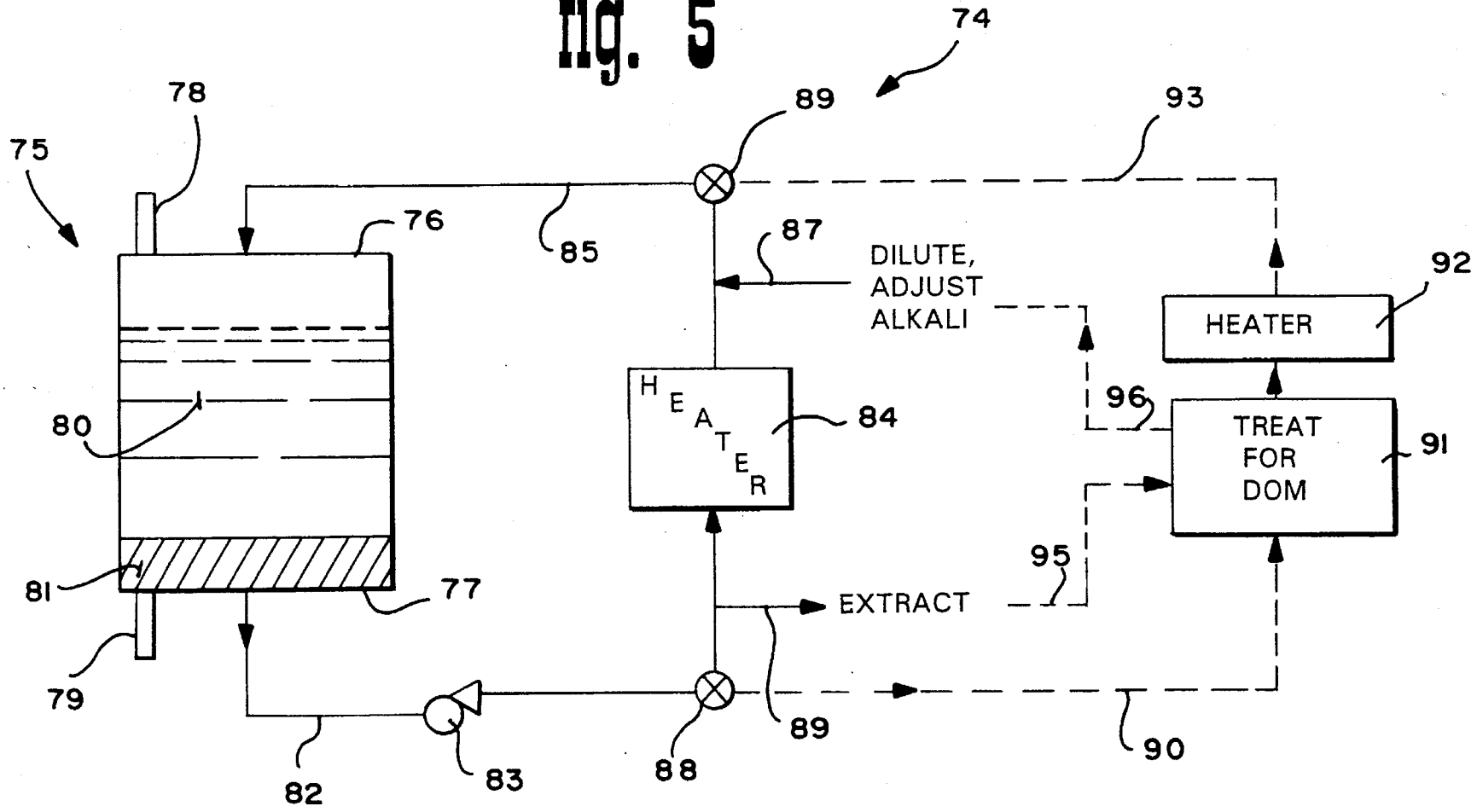
FIG. 5 is a schematic side view of another embodiment of exemplary batch digester according to the present invention.

FIG. 5 schematically illustrates an exemplary commercial (i.e. producing at least 100 tons of pulp per day) batch digester system 74 according to the present invention. A laboratory size version of the solid line embodiment of system 74 as seen in FIG. 5 was used to obtain plot C from FIG. 2, and has been in use for many years. The system 74 includes a batch digester 75 having a top 76 and bottom 77, with a chips inlet 78 at the top and outlet 79 at the bottom, with a chips column 80 established therein during cooking. A screen 81 is provided at one level therein (e.g. adjacent the bottom 77) connected to a withdrawal line 82 and pump 83, leading to a heater 84. From the heater 84 the heated liquid is recirculated through line 85 back to the digester 75, introduced at a level therein different than the level of screen 81 (e.g. near the top 76).

Prior to the heater 84, a significant portion (e.g. to provide about three turnovers of liquid per hour) of the withdrawn lignin in line 82 is extracted at line 86. This relatively high DOM concentration liquor is replaced by substantially DOM free (at least greatly reduced DOM concentration compared to that in line 86) liquor at 87. The substantially DOM-free liquor added at 87 may have an alkali concentration that is varied as desired to effect an appropriate kraft cook. A varying alkali concentration may be used to simulate a continuous kraft cook in the batch vessel 75. Valves 88, 89 may be provided to shut down or initiate liquor flows, and/or to substitute or supplement the desired treatment using the system shown in dotted line in FIG. 5.

In accordance with the invention, instead of, or supplemental to, the extraction and dilution lines 86, 87, the desired level of DOM and its components (e.g. <50 g/; DOM, <25 g/l lignin, and <10 g/l hemi-cellulose) may be achieved by treating the extracted liquor for DOM, for example by passing the high DOM level liquor in line 90 to a treatment stage 91 - - - like the stage 16 in FIG. 1 - - - where DOM, or selected constituents thereof, are removed to greatly reduce their concentrations in the liquor. Makeup white liquor (not shown) can be added too, the liquor reheated in heater 92, and then returned via line 93 to the digester 75 instead of using lines 90 and 93, lines 86 and 87 can be connected up to treatment unit 91, as schematically illustrated by dotted lines 95, 96 in FIG. 5.

It will thus be seen that according to the present invention, a method and apparatus have been provided which enhance the strength of kraft pulp by removing, minimizing (e.g. by dilution), or passifying DOM during the entire bulk delignification. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures, methods, and products.

What is claimed is:

1. A method of draft cooking comminuted cellulose fibrous material at a rate of at least 100 tones of pulp per day by keeping the effective dissolved organic material concentration at 100 grams per liter or less throughout substantially the entire kraft cook, and wherein the effective concentration of dissolved organic material is obtained by continuously passing substantially dissolved organic material-free cooking liquor into and out of contact with the cellulose material until completion of the kraft cook thereof.

2. A method as recited in claim 1 further practiced by keeping the effective dissolved lignin concentration component of the dissolved organic material at 50 g/l or less throughout substantially the entire kraft cook.

3. A method as recited in claim 2 further practiced by keeping the effective dissolved hemi-cellulose concentration component of the dissolved organic material at 15 g/l or less throughout substantially the entire kraft cook.

4. A method as recited in claim 1 utilizing a batch digester, and comprising the further steps of filling the digester with cellulose material prior to kraft cooking thereof, and then after kraft cooking discharging kraft pulp from the digester.

5. A method as recited in claim 4 wherein said passing step is practiced by introducing the cooking liquor at one level in the digester, withdrawing it at another level, extracting a substantial part of the liquor from the withdrawn flow, heating the remaining flow, introducing substantially dissolved organic material free dilution liquor into the remaining flow, and using the remaining flow with added dilution liquor as the introduction liquor.

6. A method as recited in claim 1 further practiced by keeping the effective dissolved organic material concentration at about 50 g/l or less throughout substantially the entire kraft cook.

7. A method as recited in claim 6 further practiced by keeping the effective dissolved lignin concentration component of the dissolved organic material at about 25 g/l or less throughout substantially the entire kraft cook.

8. A method as recited in claim 6 further practiced by keeping the effective dissolved hemi-cellulose concentration component of the dissolved organic material at about 10 g/l or less throughout substantially the entire kraft cook.

9. A method of producing kraft pulp by cooling comminuted cellulosic fibrous material comprising the steps of continuously, at a plurality of different stages during draft cooking of the material to produce pulp and liquor surrounding the pulp which contains dissolved organic material:

(a) extracting from the cellulosic material liquor containing a level of dissolved organic material substantial enough to adversely affect pulp strength; and (b) replacing in the cellulosic material some or all of the extracted liquor with liquor containing a substantially lower effective dissolved organic material level than the extracted liquor, so as to positively affect pulp strength;

wherein steps (a) and (b) are practiced to keep the effective dissolved organic material concentration at 100 g/l or less throughout substantially the entire kraft cook and wherein the different stages include the beginning, middle, and end of the cooking process.

10. A method as recited in claim 9 wherein step (b) is practiced by replacing the extracted liquor with liquor selected from the group consisting of water, substantially dissolved organic material free white liquor, pressure-heat treated black liquor, washer filtrate, cold blow filtrate, and combinations thereof.

11. A method as recited in claim 9 wherein steps (a) and (b) are practiced, for at least one stage during cooking, by extracting black liquor, in step (a), and pressure-heat treating the extracted black liquor under pressure and temperature conditions to significantly passivate the adverse effects of dissolved organic material.

12. A method as recited in claim 11 wherein said pressure-heat treating is practiced at a super-atmospheric pressure and a temperature of about 170°–350° C., and at least 20° C. above cooking temperature, for about 5–90 minutes.

13. A method as recited in claim 9 utilizing a continuous vertical digester, and wherein steps (a) and (b) are practiced at at least two different vertical levels of the continuous digester.

14. A method as recited in claim 9 wherein steps (a) and (b) are practiced to increase the tear strength of the kraft pulp produced by at least about 10% at a specified tensile for fully refined pulp compared to kraft pulp produced under identical conditions but without steps (a) and (b).

15. A method as recited in claim 9 wherein steps (a) and (b) are practiced to increase the tear strength of the kraft pulp produced by at least about 15% at a specified tensile for fully refined pulp compared to kraft pulp produced under identical conditions but without steps (a) and (b).

16. A method as recited in claim 9 comprising the further step (c) of heating the replacement liquor from step (b) to substantially the same temperature as the extracted liquor prior to the replacement liquor being introduced into contact with the material being cooked.

17. A method as recited in claim 9 wherein steps (a) and (b) are practiced during at least the following stages: impregnation, near the start of the cook, and near the end of tile cook.

18. A method as recited in claim 9 comprising the further step (c) of treating extracted liquor from at least one stage to remove, or passivate the adverse effects of, the dissolved organic material therein, including dissolved cellulose and hemi-cellulose and using the treated extracted liquor as the liquor for step (b) at the same stage.

19. A method as recited in claim 18 wherein step (c) is practiced to remove dissolved organic material by a process selected from the group consisting of absorption, precipitation, ultrafiltration, destruction, gravity separation, supercritical extraction, solvent extraction, and evaporation.

20. A method as recited in claim 9 comprising the further step (c) of treating extracted liquor from at least one stage to remove, or passivate the adverse effects of, the dissolved organic material therein, including dissolved cellulose and hemi-cellulose, and using the treated extracted liquor as the liquor for step (b) at a different stage.

21. A method as recited in claim 20 wherein step (c) is practiced to remove dissolved organic material by a process selected from the group consisting of absorption, precipitation, ultrafiltration, destruction, gravity separation, supercritical extraction, solvent extraction, and evaporation.

22. A method as recited in claim 9 wherein step (b) is practiced by replacing the extracted liquor with liquor selected from the group consisting of water, substantially dissolved organic material free white liquor, washer filtrate, cold blow filtrate, and combinations thereof.

23. A method as recited in claim 22 utilizing a continuous vertical digester, and wherein steps (a) and (b) are practiced at at least three different vertical levels of the continuous digester.

24. A method as recited in claim 23 wherein steps (a) and (b) are practiced to increase-the tear strength of the kraft pulp produced by at least about 10% at a specified tensile for fully refined pulp compared to kraft pulp produced under identical conditions but without steps (a) and (b).

25. A method as recited in claim 22 wherein steps (a) and (b) are practiced to increase the tear strength of the kraft pulp produced by at least about 10% at a specified tensile for fully refined pulp compared to kraft pulp produced under identical conditions but without steps (a) and (b).

26. A method as recited in claim 22 comprising the further step (c) of heating the replacement liquor from step (b) to substantially the same temperature as the extracted liquor prior to the replacement liquor being introduced into contact with the material being cooked.

27. A method as recited in claim 9 wherein steps (a) and (b) are practiced to maintain the effective dissolved organic material concentration at about 50 g/l or less throughout substantially the entire kraft cook.

28. A method as recited in claim 27 wherein steps (a) and (b) are practiced to increase the tear strength of the kraft pulp produced by at least about 10% at a specified tensile for fully refined pulp compared to kraft pulp produced under identical conditions without steps (a) and (b).

29. A method as recited in claim 28 wherein step (b) is practiced by replacing the extracted liquor with liquor selected from the group consisting of water, washer filtrate, cold blow filtrate, and combinations thereof.

30. A method as recited in claim 27 wherein step (b) is practiced by replacing the extracted liquor with liquor selected from the group consisting of water, washer filtrate, cold blow filtrate, and combinations thereof.

31. A method as recited in claim 9 wherein steps (a) and (b) are practiced to keep the effective dissolved lignin concentration at 50 g/l or less throughout substantially the entire kraft cook.

32. A method as recited in claim 9 wherein steps (a) and (b) are practiced to keep the effective dissolved lignin concentration at about 25 g/l or less throughout substantially the entire kraft cook.

33. A method as recited in claim 9 wherein steps (a) and (b) are practiced to keep the effective dissolved hemicellulose concentration at 15 g/l or less throughout substantially the entire kraft cook.

34. A method as recited in claim 9 wherein steps (a) and (b) are practiced to keep the effective dissolved hemicellulose concentration at about 10 g/l or less throughout substantially the entire kraft cook.

35. A method as recited in claim 9 wherein steps (a) and (b) are practiced to increase the tear strength of the kraft pulp produced by at least about 10% at a specified tensile for fully refined pulp compared to kraft pulp produced under identical conditions but without steps (a) and (b).

36. A method as recited in claim 35 wherein step (b) is practiced by replacing the extracted liquor with liquor selected from the group consisting of water, washer filtrate, cold blow filtrate, and combinations thereof.

37. A method as recited in claim 9 wherein step (b) is practiced by replacing the extracted liquor with liquor selected from the group consisting of water, washer filtrate cold blow filtrate and combinations thereof.

38. A method as recited in claim 9 wherein step (b) is practiced by replacing the extracted liquor with liquor selected from the group consisting of water, washer filtrate, cold blow filtrate, and combinations thereof.

39. A method of kraft cooking comminuted cellulose fibrous material in a digester, comprising the steps of continuously, at a plurality of different stages during kraft cooling of the material to produce pulp and liquor surrounding the pulp which contains dissolved organic material: (a) withdrawing liquor from the digester, (b) treating the withdrawn liquor to effectively remove a significant portion of the effective dissolved organic material therein so as to positively affect pulp strength, and (c) reintroducing some or all of the treated, lower dissolved organic material concentration, liquor into the digester; wherein steps (a) through (c) are practiced to keep the effective dissolved organic material concentration at 100 g/l or less throughout substantially the entire kraft cook in the digester and wherein the different stages include the beginning, middle, and end of the cooling process.

40. A method as recited in claim 39 wherein step (b) is practiced by a process selected from the group consisting of absorption, solvent extraction, precipitation, ultrafiltration, destruction, supercritical extraction, gravity separation, and evaporation.

41. A method as recited in claim 39 wherein step (b) is practiced by heating the withdrawn liquor at superatmospheric pressure at a temperature of at least about 190° C. for about 5–90 minutes.

* * * * *

UNITED STATES PATENT AND TRADEMARK OFFICE

CERTIFICATE OF CORRECTION

PATENT NO. : 5,489,363

DATED : February 6, 1996

INVENTOR(S) : Bruno S. Marcoccia, et al.

It is certified that error appears in the above-indentified patent and that said Letters Patent is hereby corrected as shown below:

Column 9:

Claim 1, line 1, replace "draft" with -- kraft --;

line 2, replace "tones" with -- tons --.

Column 10:

Claim 9, line 1, replace "cooling" with -- cooking --;

line 3, replace "draft" with -- kraft --.

Claim 17, line 4, replace "tile" with -- the --.

Claim 39, lines 4 and 15, replace "cooling" with -- cooking --.

Signed and Sealed this

Eighteenth Day of June, 1996

*Attest:*

Bruce Lehman

BRUCE LEHMAN

*Attesting Officer*

*Commissioner of Patents and Trademarks*